US008308291B2

(12) United States Patent
Norman et al.

(10) Patent No.: US 8,308,291 B2
(45) Date of Patent: Nov. 13, 2012

(54) TEMPLE HANGER WITH SECURITY DEVICE FOR WIRE FRAME GLASSES

(75) Inventors: Michael Norman, East Brunswick, NJ (US); Alex Tetiyevsky, Springfield, NJ (US); Jake Strassburger, South Plainfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 13/187,849

(22) Filed: Jul. 21, 2011

(65) Prior Publication Data

US 2012/0026453 A1 Feb. 2, 2012

Related U.S. Application Data

(60) Provisional application No. 61/368,911, filed on Jul. 29, 2010, provisional application No. 61/415,126, filed on Nov. 18, 2010.

(51) Int. Cl.
*G02C 1/00* (2006.01)

(52) U.S. Cl. ..... 351/158; 24/3.3; 248/309.1

(58) Field of Classification Search ..... 351/158, 351/41; 248/309.1, 902, 224.8, 690, 300; 24/3.3, 16, 17; D9/457, 722
See application file for complete search history.

(56) References Cited

U.S. PATENT DOCUMENTS

| | | | | | |
|---|---|---|---|---|---|
| 5,000,410 | A | * | 3/1991 | Beavers | 248/205.3 |
| 5,046,696 | A | * | 9/1991 | Lee | 248/309.1 |
| 5,129,617 | A | | 7/1992 | MacWilliamson | |
| 5,144,345 | A | * | 9/1992 | Nyman | 351/158 |
| 5,340,074 | A | | 8/1994 | Porcaro et al. | |
| 5,504,541 | A | | 4/1996 | Kolton et al. | |
| 5,559,567 | A | | 9/1996 | Kolton et al. | |
| 5,699,990 | A | * | 12/1997 | Seach | 248/309.1 |
| 5,864,924 | A | | 2/1999 | Rodriguez | |
| 7,523,909 | B1 | | 4/2009 | Liebers et al. | |
| 7,762,511 | B1 | | 7/2010 | Liebers et al. | |
| D650,211 | S | * | 12/2011 | Liebers et al. | D6/567 |

* cited by examiner

*Primary Examiner* — Hung Dang
(74) *Attorney, Agent, or Firm* — Hoffmann & Baron, LLP

(57) ABSTRACT

A hanger assembly is provided for securing a tag to a pair of eyeglasses that has a frame with two temple members connected to two hinged legs. The hanger assembly includes a hanger, a ledge, a support member, a zip-tie and optionally a hook. The ledge extends outwardly from the back side of the hanger and can have one or more apertures. The zip-tie surroundingly engages the ledge and the first temple member to secure the hanger to the eyeglasses. The temple hanger assembly can also include a security device support section and a security device installed therein. The security device can be a radio frequency identification (RFID) tag or electronic article surveillance (EAS) tag.

21 Claims, 9 Drawing Sheets

DETAIL "A"

TEMPLE HANGER WITH SECURITY DEVICE FOR WIRE FRAME GLASSES

This application claims priority from provisional application Ser. No. 61/368,911, filed on Jul. 29, 2010, and from provisional application Ser. No. 61/415,126, filed on Nov. 18, 2010, both of which are incorporated herein in their entirety.

FIELD OF THE INVENTION

The present invention relates to hangers that are used in the packaging and display of eyeglasses. In particular, the present invention relates to hangers with security devices that are secured to the portion of the eyeglasses corresponding to the wearer's temple and hung from merchandise displays.

BACKGROUND OF INVENTION

Small articles are commonly displayed for sale in retail stores on racks or in display cases where the articles are hung. A variety of different hangers (also referred to as tags) have been used that are secured to the article and have a means for attaching the article to the rack for display. Several of the criteria for designing these hangers relate to the cost of manufacturing and the cost of attaching them to the articles. Another important design consideration is that the hangers must be convenient for the merchant to display and they must be convenient for the customer to remove after purchase.

Hangers used for displaying eyeglasses must be designed so that the customer can easily view the eyeglasses and remove them from the display rack. The hangers must also be designed so that the customer can easily try on a pair of eyeglasses without having to remove the hanger. Because a customer may try on several pairs of eyeglasses before making a selection, the hangers must be designed so that they can be removed and then reinstalled on the rack by the customer numerous times without damaging either the eyeglasses or the hangers.

These hangers or tags may include radio frequency identification (RFID) tags or electronic article surveillance (EAS) tags. These terms are referred to collectively herein as either "security devices," "electronic security devices" or "electronic tags." Electronic tags attached to articles have a wide variety of uses, including tracking, inventory control and security. These electronic tags can also provide electronically readable information pertaining to the articles. EAS tags may be used with an alarm system to provide theft deterrence by monitoring the location of the tags and any unauthorized movement of the article containing the EAS tag from a predetermined area. The tags can be enclosed in or attached to a variety of different devices, such as holders or housings, which accommodate the electronic tag and are used to attach the tags to articles. The tags are secured to the article so that they remain with the article until after the time of purchase.

With respect to some articles, such as eyeglasses (particularly wire frame eyeglasses), various hangers have been developed that are secured to different locations on the eyeglasses. A convenient but troublesome location for application of the hangers is near the temple portion of the eyeglasses where the legs are connected to the frame by hinges. While this is a desirous location to apply the hanger for a variety of reasons, it is difficult to retain the hanger at this location because the hanger can be easily removed by sliding the hanger down the leg of the eyeglasses.

Accordingly, it is desirable to provide a hanger with a security device, which may be secured to the temple portion of a pair of eyeglasses and which cannot be readily removed therefrom. Moreover, there is a need for a hanger for displaying eyeglasses that can be easily removed and reinstalled in the display and that does not prevent the eyeglasses from being worn by a customer. There is also a need for a hanger for displaying eyeglasses with a security device that can be economically manufactured and easily and firmly secured to the eyeglasses.

SUMMARY OF THE INVENTION

In accordance with the present invention, a hanger assembly for securing a tag to a pair of eyeglasses, which has a frame with two temple members connected to two hinged legs, is provided. The hanger assembly in its broadest embodiment includes a hanger, a ledge, a support member and a zip-tie. The hanger has a side wall that includes a front side, a back side, a top edge and a bottom edge. The ledge extends outwardly from the back side of the side wall and has a top surface, a bottom surface, a first end and a second end. The ledge can also have one or more center walls extending from the top surface between the first and second ends, a first aperture located between the center wall and the second end and a second aperture in each of the one or more center walls. The top surface of the hanger substantially corresponds to the top surface of the ledge. The temple hanger can also include a hook extending from the top edge of the side wall of the hanger and a bar code containing information relating to the eyeglasses including the price.

The support member extends from the bottom surface of the ledge to a distal end with a groove. Preferably, the support member is substantially triangular in shape and has three sides and three corners. The first side is disposed next to the bottom surface of the ledge and a first corner opposite the first side forms the distal end. In preferred embodiments, the support member extends beyond the bottom edge of the side wall. The hanger has a vertical axis extending between the top edge and the bottom edge of the side wall and the hook and the support member are preferably aligned with each other and substantially parallel to the vertical axis.

The zip-tie has a plain first end and a second end with a locking mechanism. The first temple member of the eyeglasses is positioned in the groove of the support member and the zip-tie surroundingly engages the ledge and the first temple member to secure the hanger to the eyeglasses. The first end of the zip-tie can also be inserted into the first aperture in the ledge from the top surface and around the first temple member and the first end of the ledge, through the second aperture(s) in the center wall(s) and into the locking mechanism. When the zip-tie is tightened, the hanger is secured to the eyeglasses. The locking mechanism on the second end of the zip-tie can be larger than the first aperture in the ledge so that it does not pass through the aperture when tightened. After the zip-tie secures the hanger to the pair of eyeglasses, the locking mechanism on the second end of the zip-tie can not be unlocked.

In a preferred embodiment, the temple hanger assembly includes a security device support section comprising a first end attached to the bottom edge of the hanger and a security device installed therein. The security device support section can also include a second distal end with an aperture and a cavity located between the first end of the support section and the second distal end. Preferably, the security device support section is attached to the hanger by one or more straps. The security device is preferably installed in the cavity and the first leg of the eyeglasses is preferably inserted in the aperture in the security device support section before the zip-tie secures the hanger to the eyeglasses. The security device can be a radio frequency identification (RFID) tag or electronic article surveillance (EAS) tag.

BRIEF DESCRIPTION OF THE FIGURES

The preferred embodiments of the temple hanger with an optional security device for eyeglasses of the present invention, as well as other objects, features and advantages of this invention, will be apparent from the accompanying drawings wherein.

DETAILED DESCRIPTION OF THE INVENTION

The present invention is a temple hanger assembly for a pair of eyeglasses having a frame with two temple members connected to two hinged legs. The temple hanger assembly includes a temple hanger, a zip-tie and can optionally include an electronic security device. The temple hanger is attached to one of the temple members of a pair of eyeglasses, preferably wire rim eyeglasses, so that it cannot be removed without cutting the zip-tie. As used herein, the term "temple member" refers to the structures on each side of a pair of eyeglasses located between the frame and the hinge that connects the legs. The top of the temple hanger has a hook for attaching the hanger to a rack or a display and the bottom of the temple hanger has a support member that contacts the pair of eyeglasses. The security device support section can extend from the bottom of the temple hanger and can have an aperture on the distal end for receiving one of the hinged legs of the eyeglasses. After the leg is inserted into the aperture, the temple member of the eyeglasses is secured to the hanger with the zip-tie. A bar code containing information relating to the eyeglasses, such as price, model number, size and color, can also be affixed to the hanger assembly; either to the hanger or the security device support section. Because the hanger assembly is securely fastened to the eyeglasses and difficult to remove, the bar code provides added security against tampering and theft. A thief cannot easily switch bar codes for an expensive pair of eyeglasses with a pair of less expensive eyeglasses by switching the hangers.

The zip-tie (also referred to by those skilled in the art as a cable tie) has a plain first end and a second end with a locking mechanism. Typically, a zip-tie forms a loop with the first end inserted into the locking mechanism on the second end. After an object is located inside the loop, the first end of the zip-tie is pulled through the locking mechanism to secure the object in place. The term "zip-tie" as used herein is not limited to ties that are used with bundled wires and cables, but also refers to any type of plastic tie which includes a strap and a locking head on opposing ends or which has opposing ends that can be attached together to form a closed loop. Examples of such ties are found in U.S. Pat. No. 3,186,047 to Schwester et al.; U.S. Pat. Nos. 5,621,949 and 5,630,252 to Wells; U.S. Pat. Nos. 6,076,235; 6,128,809; and 6,185,791 to Khokhar; U.S. Pat. No. 7,017,237 to Magno, Jr. et al.; and U.S. Pat. No. Des. 205,940 to Miller; all of which are incorporated herein in their entirety. However, the examples in these patents are not intended to limit the construction of the term "zip-tie" as used herein in any way.

Figure 1:
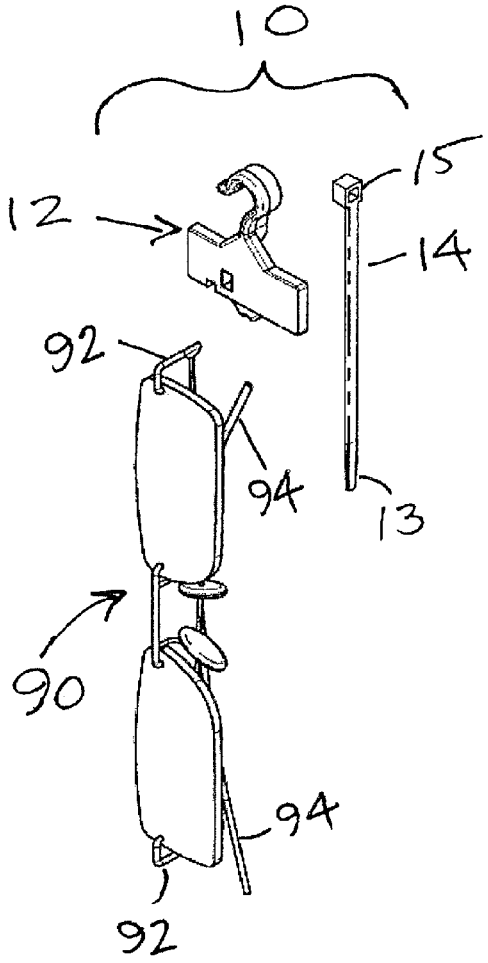
FIG. 1 is a perspective view of the front side of a first embodiment of the temple hanger assembly for wire frame eyeglasses of the present invention and a pair of wire frame eyeglasses.
Figure 13:
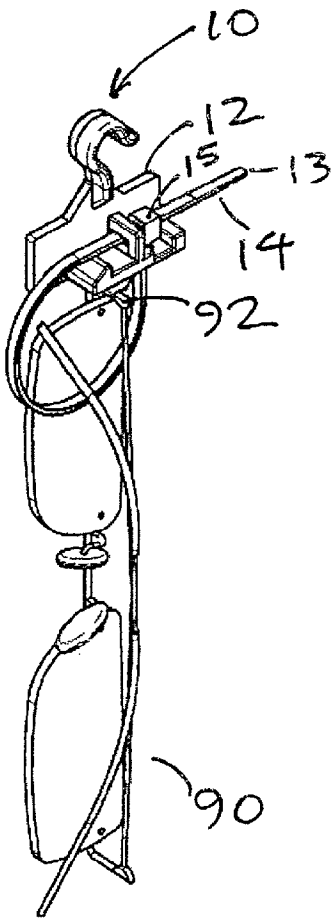
FIG. 13 is a perspective view of the back side of the first embodiment of the temple hanger shown in FIG. 1 attached to a pair of wire frame eyeglasses with a zip-tie before it is tightened.

Referring now to the drawings, FIGS. 1-15 show a first embodiment of the temple hanger assembly 10 without a security device. As shown in FIG. 1, the assembly 10 includes a temple hanger 12 and a zip-tie 14, which is attached to a pair of wire frame eyeglasses 90. The pair of eyeglasses 90 has a pair of temple members 92 on either side which are connected to a pair of legs 94. The zip-tie 14 is used to secure the temple hanger 12 to one of the temple members 92 of the pair of eyeglasses 90 (see FIGS. 12-15). The zip-tie 14 has a plain end 13 that is inserted into a locking mechanism 15 on the opposing end to form a loop (FIG. 13). After the zip-tie 14 is placed around one of the temple members 92 the plain end 13 is inserted into the locking mechanism 15 and tightened.

Figure 2:
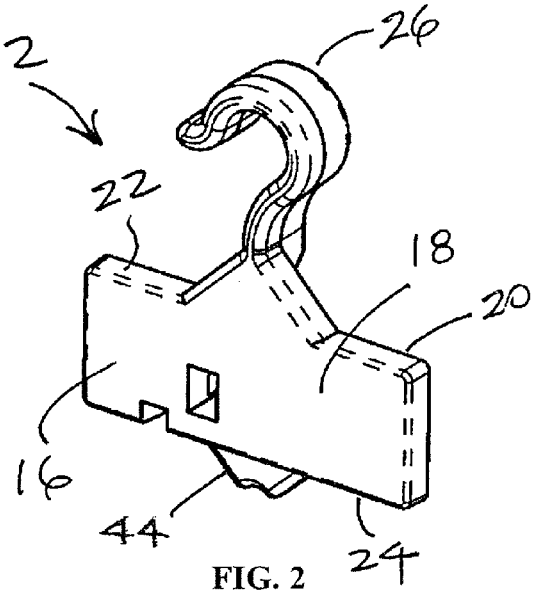
FIG. 2 is a top perspective view of the front side of the first embodiment of the temple hanger shown in FIG. 1.
Figure 3:
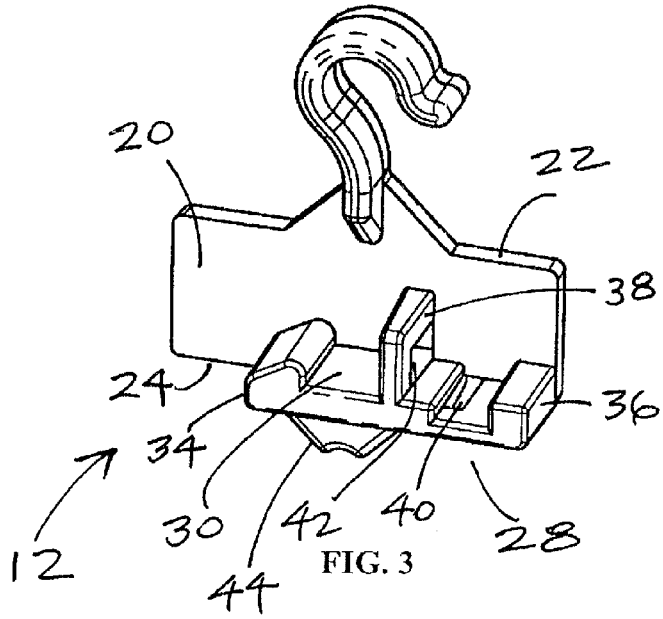
FIG. 3 is a top perspective view of the back side of the first embodiment of the temple hanger shown in FIG. 1.

FIG. 2 shows the temple hanger 12, which has a side wall 16 with a front side 18, a back side 20, a top edge 22 and a bottom edge 24. The temple hanger 12 also has a hook 26 extending from the top edge 22 of the side wall 16. FIG. 3 shows the back side 20 of the temple hanger 12 with a ledge 28 extending outwardly from the back side 20 of the hanger 12. The ledge 28 includes a top surface 30 a bottom surface 32 (FIGS. 4 and 5), a first end 34, a second end 36 and a center wall 38 therebetween. The ledge 28 has an aperture 40 located between the center wall 38 and the second end 36 and the center wall 38 has an aperture 42 located near the top surface 30.

Figures 4, 5, 6:
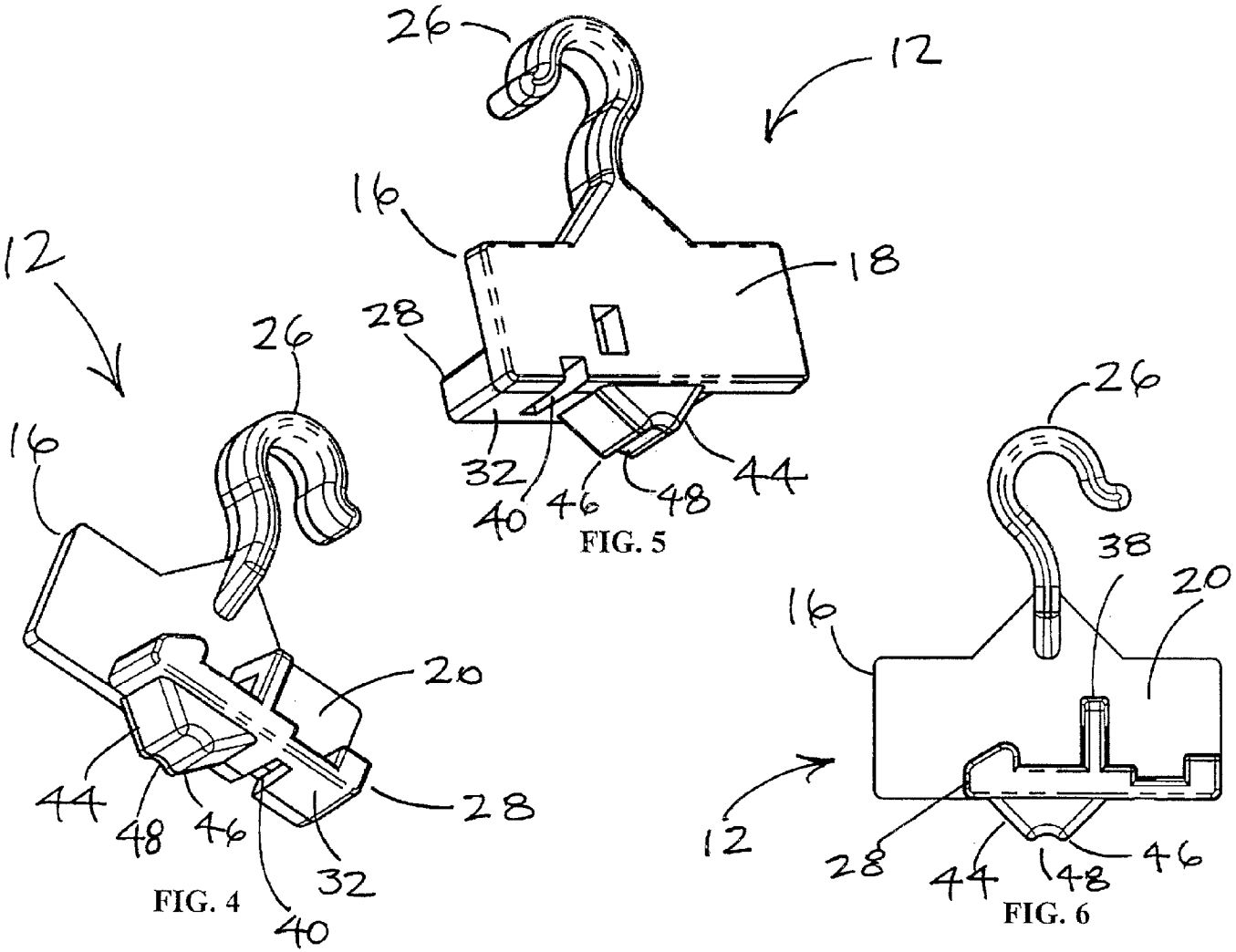
FIG. 4 is a bottom perspective view of the back side of the first embodiment of the temple hanger shown in FIG. 1.
FIG. 5 is a bottom perspective view of the front side of the first embodiment of the temple hanger shown in FIG. 1.
FIG. 6 is a side view of the back side of the first embodiment of the temple hanger shown in FIG. 1.

FIGS. 4-6 show a support member 44 extending from the bottom surface 32 of the ledge 28 to beyond the bottom edge 24 of the side wall 16. The support member 44 has a distal end 46 with a groove 48 for receiving one of the temple members 92 of the pair of eyeglasses 90. The groove 48 is preferably oriented perpendicular to the side wall 16 of the hanger 12 and is adapted to receive one of the temple members 92 of the wire frame eyeglasses 90 (FIGS. 12-15).

Figure 15:
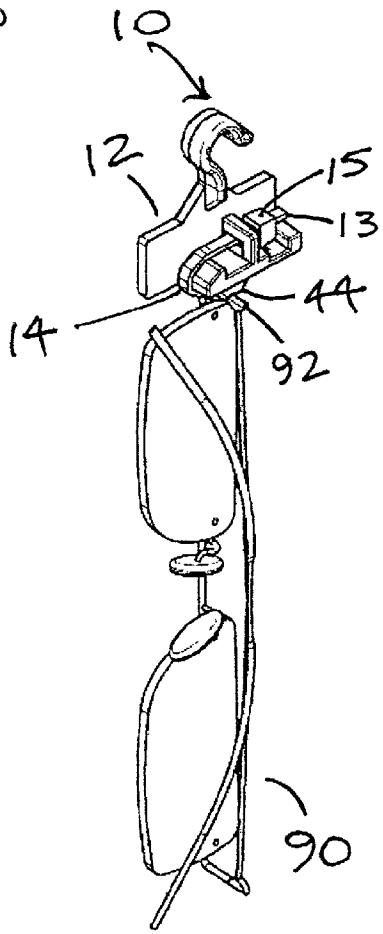
FIG. 15 is a perspective view of the back side of the first embodiment of the temple hanger shown in FIG. 1 attached to a pair of wire frame eyeglasses with a zip-tie after it is tightened.

In FIGS. 4-6, the support member 44 has a triangular shape. However, the support member 44 can have other shapes. The important feature of the support member 44 is the groove 48 at its distal end 46, which properly orients the pair of eyeglasses 90 relative to the side wall 16 of the hanger 12. The support member 44 and groove 48 also allow the zip-tie 14 to loop very tightly around the ledge 28 and the temple member 92 of the pair of eyeglasses 90 (FIG. 15). The zip-tie 14 can be made from a plastic, such as polypropylene, or nylon, as well as other materials well known to those skilled in the art. If the support member 44 did not have a groove 48, a gap between the ledge 28 and the zip-tie 14 could form. This gap could be large enough to allow the eyeglasses 90 to be removed from the hanger 12 and defeat one of the main objectives of the invention. Therefore, the groove 48 on the distal end 46 of the support member 44 is dimensioned to insure that the hangar 12 is securely attached to the eyeglasses. Moreover, because the zip-tie 14 is tightly secured around the ledge 28 of the hanger 12, it is very difficult for a thief to remove the hanger 12 from the eyeglasses 90.

Figures 7, 8, 9, 10, 11:
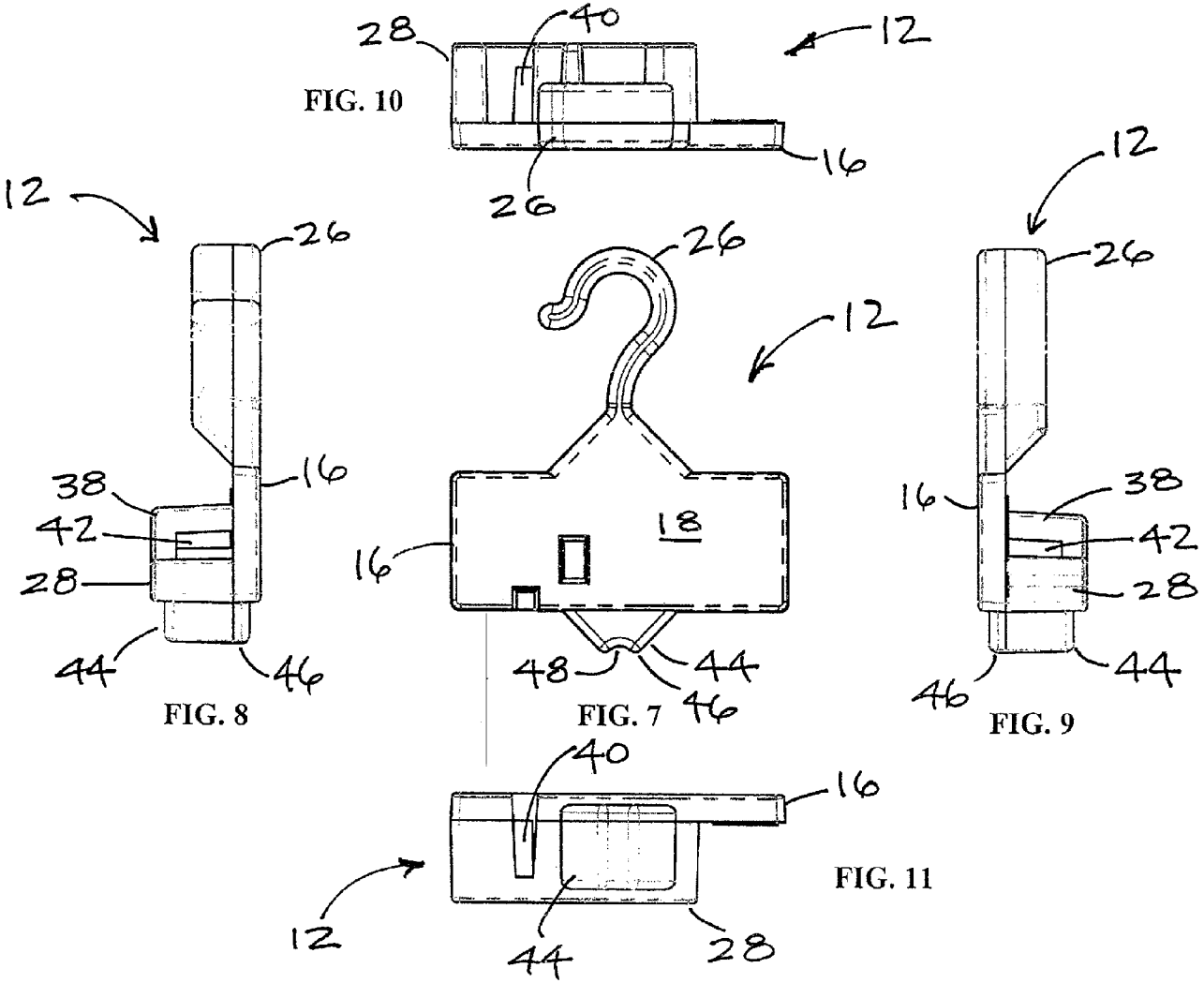
FIG. 7 is a side view of the front side of the first embodiment of the temple hanger shown in FIG. 1.
FIG. 8 is an end view of the left end of the first embodiment of the temple hanger shown in FIG. 1.
FIG. 9 is an end view of the right end of the first embodiment of the temple hanger shown in FIG. 1.
FIG. 10 is a top view of the first embodiment of the temple hanger shown in FIG. 1.
FIG. 11 is a bottom view of the first embodiment of the temple hanger shown in FIG. 1.

FIGS. 7-11 show a front view, left side view, right side view, top view and bottom view, respectively, of the hanger 12. The hanger 12 is preferably constructed from a plastic material using well known processes. The hook 26 and the support member 44 are aligned along the central axis of the hanger 12 so that the weight of the pair of eyeglasses 90 attached to the hanger 12 is directly transferred to the hook 26 (FIGS. 12-15). FIGS. 8 and 9 show the aperture 42 in the center wall 38 and FIGS. 10 and 11 show the aperture 40 in the support member 44. The zip-tie 14 is inserted through the two apertures 40, 42 and around the temple member 92 of a pair of eyeglasses 90. The zip-tie 14 is then tightened to secure the temple member 92 in the groove 48 on the distal end 46 of the support member 44 (FIGS. 12-15).

Figure 14:
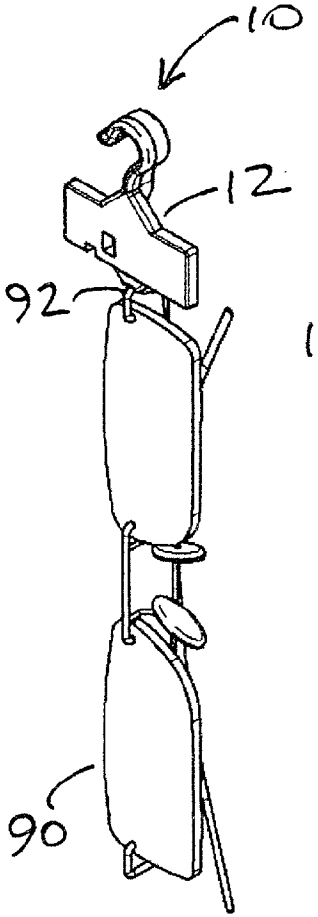
FIG. 14 is a perspective view of the front side of the first embodiment of the temple hanger shown in FIG. 1 attached to a pair of wire frame eyeglasses with a zip-tie after it is tightened.
Figure 12:
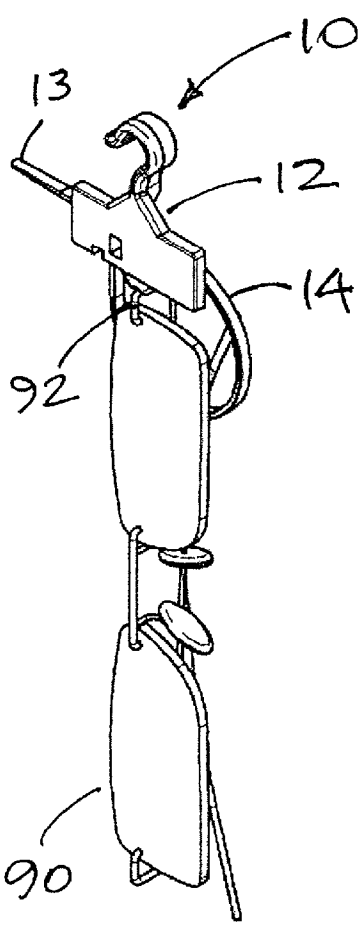
FIG. 12 is a perspective view of the front side of the temple hanger shown in FIG. 1 attached to a pair of wire frame eyeglasses with a zip-tie before it is tightened.

FIGS. 12-15 show the hanger assembly 10 attached to a pair of eyeglasses 90. FIGS. 12 and 13 show the plain end 13 of the zip-tie 14 inserted in the aperture 40 in the ledge 28 (FIG. 3), looped around the temple member 92 of the pair of wire frame eyeglasses 90, inserted through aperture 43 in the center wall 38 (FIG. 3) and then fastened in the locking mechanism 15. FIGS. 14 and 15 show the zip-tie 14 after it has been tightened to secure the temple member 92 of the pair of wire frame eyeglasses 90 in the groove 48 of the support member 44 (FIG. 6).

Figure 31:
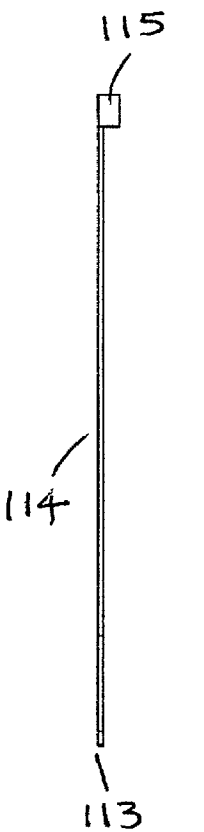
FIG. 31 is a side view of a preferred embodiment of a zip-tie used in all of the embodiments of the temple hanger assembly.
Figure 32:
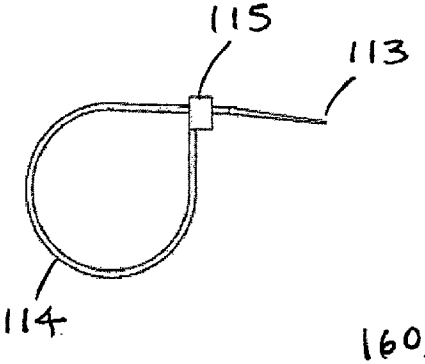
FIG. 32 is a side view of the zip-tie shown in FIG. 31, after the plain end is inserted in the locking mechanism.
Figure 33:
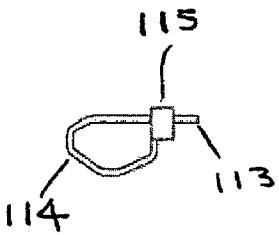
FIG. 33 is a side view of the zip-tie shown in FIG. 31, after it is tightened.
Figure 34:
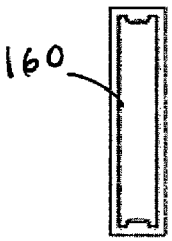
FIG. 34 is a front view of the electronic security device used in the second embodiment of the temple hanger assembly of the present invention.

Referring now to the second embodiment of the temple hanger assembly 110 with a security device 160 shown in FIGS. 16-34, FIGS. 16 and 17 show the temple hanger assembly 110, which includes a temple hanger 112, a security device support section 150 and a zip-tie 114 attached to a pair of eyeglasses 190. The pair of eyeglasses 190 has two temple members 192 on either side which are connected to a pair of legs 194. The zip-tie 114 is used to secure the temple hanger 112 to one of the temple members 192 (see FIGS. 28 and 29). The zip-tie 114 has a plain end 113 that is inserted into a locking mechanism 115 on the opposing end to form a loop (FIGS. 31-33). After the zip-tie 114 is placed around one of the temple members 192 the plain end 113 is inserted into the locking mechanism 115 and tightened.

Figure 17:
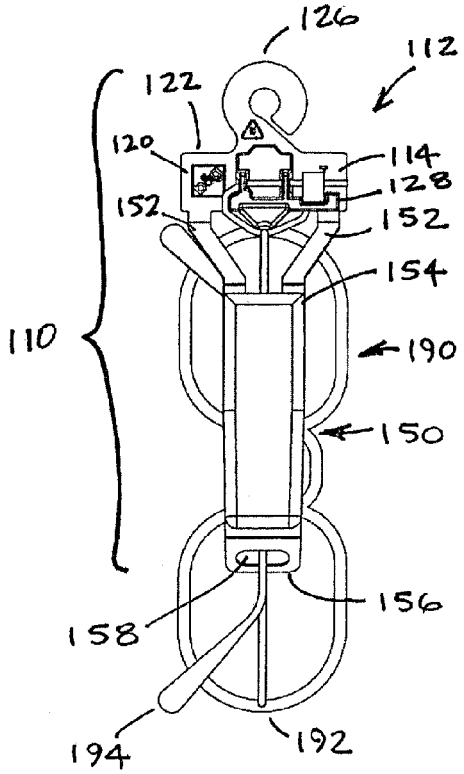
FIG. 17 is a rear view of the second embodiment of the temple hanger and eyeglasses shown in FIG. 16.

The temple hanger 112 has a side wall 116 with a front side 118, a back side 120, a top edge 122 and a bottom edge 124. The temple hanger 112 also has a hook 126 extending from the top edge 122 of the side wall 116. FIG. 17 shows the back of the temple hanger 112 with a ledge 128 extending outwardly from the back side 120 of the side wall 116. The ledge 128 includes a top surface 130 a bottom surface 132, a first end 134, a second end 136 and two center walls 138 therebetween, which extend from the top surface 130. The ledge 128 has an aperture 140 located between the center walls 138 and the second end 136 and the each center wall 138 has an aperture 142. (See FIGS. 29 and 30.)

One end 154 of the security device support section 150 is connected to the temple hanger 112 by two flexible straps 152 and the distal end 16 of the support section 150 has an aperture 158 for receiving one of the legs 194 of the eyeglasses 190. An electronic security device 160 is inserted in a cavity 155 on one side of the support section 150 to provide electronic identification and/or protection against theft. When the eyeglasses 190 are secured in the temple hanger assembly 110, the security device 160 faces the eyeglasses 190 so that the eyeglasses 190 have to be detached from the temple hanger assembly 110 before the security device 160 can be accessed.

Figure 18:
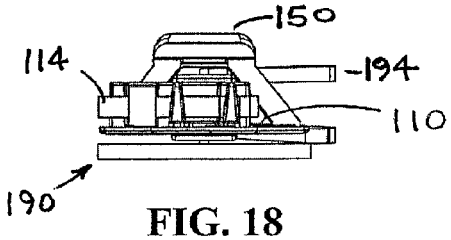
FIG. 18 is a top view of the second embodiment of the temple hanger and eyeglasses shown in FIG. 16.
Figure 16:
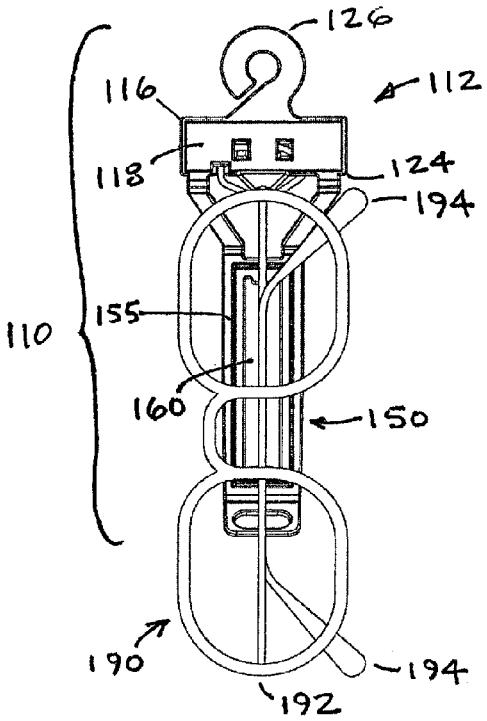
FIG. 16 is a view of the front side of a second embodiment of the temple hanger assembly of the present invention attached to a pair of wire frame eyeglasses.
Figure 19:
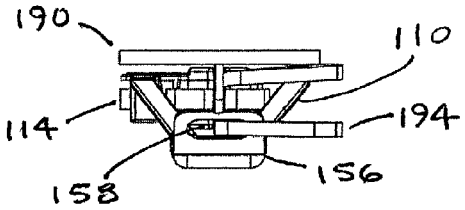
FIG. 19 is a bottom view of the second embodiment of the temple hanger and eyeglasses shown in FIG. 16.

FIGS. 18 and 19 show top and bottom views, respectively, of the temple hanger assembly 110 and the eyeglasses 190. FIG. 18 shows how the zip-tie 114 secures the temple member 192 on one side of the eyeglasses 190 to the temple hanger 112. FIG. 19 shows how one of the legs 194 of the eyeglasses 190 passes through the aperture 158 on the distal end 156 of the security device support section 150 to secure the eyeglasses 190 on the opposing side.

Figure 22:
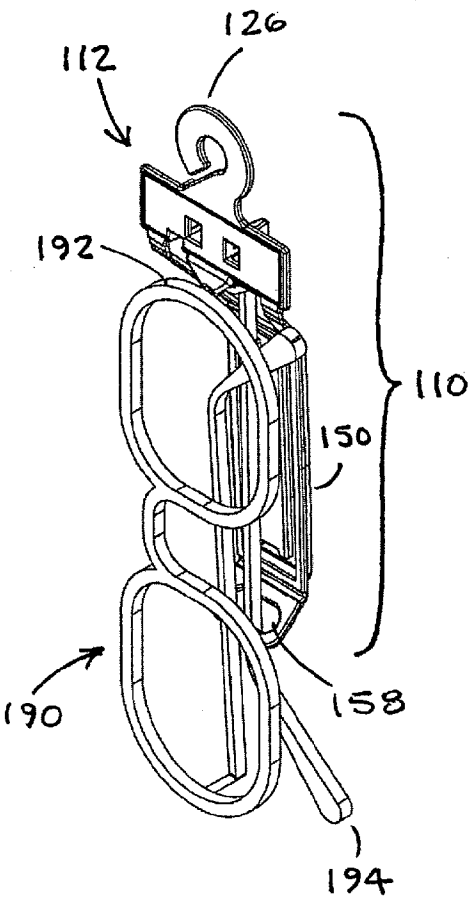
FIG. 22 is a perspective front, right side view of the second embodiment of the temple hanger and eyeglasses shown in FIG. 16.
Figure 21:
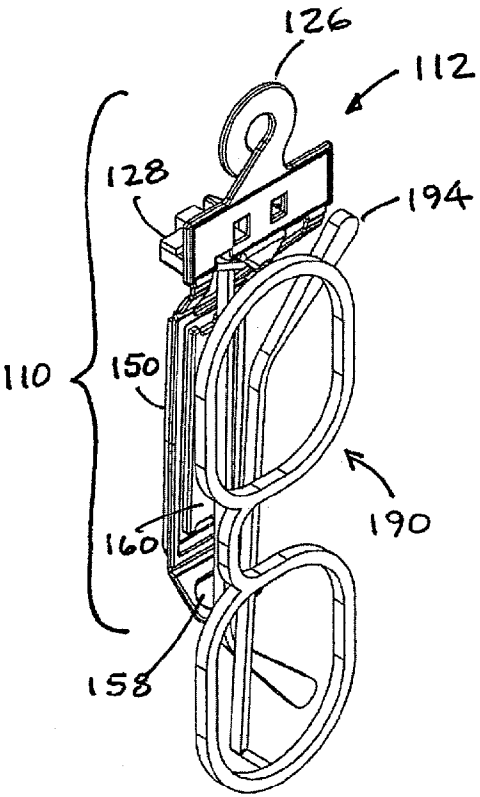
FIG. 21 is a perspective front, left side view of the second embodiment of the temple hanger and eyeglasses shown in FIG. 16.
Figure 20:
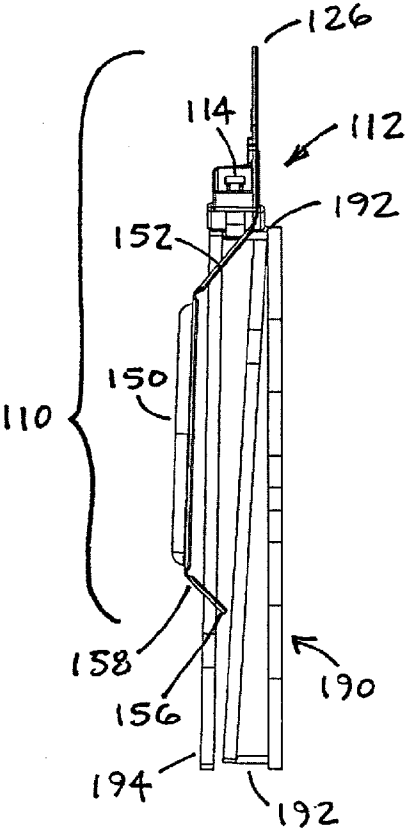
FIG. 20 is a side view of the second embodiment of the temple hanger and eyeglasses shown in FIG. 16.

FIG. 20 shows a side view of the temple hanger assembly 110 attached to a pair of eyeglasses 190. This figure clearly illustrates how the temple member 192 is secured to the temple hanger 112 by the zip-tie 114 and the leg 194 of the eyeglasses 190 is inserted in the aperture at the distal end 156 of the security device support section 150. This design allows the eyeglasses 190 to be tried on by a customer without removing the temple hanger assembly 110. Similar to FIG. 20, FIGS. 21 and 22 show two perspective views of the hanger assembly 110 attached to a pair of eyeglasses 190.

Figure 26:
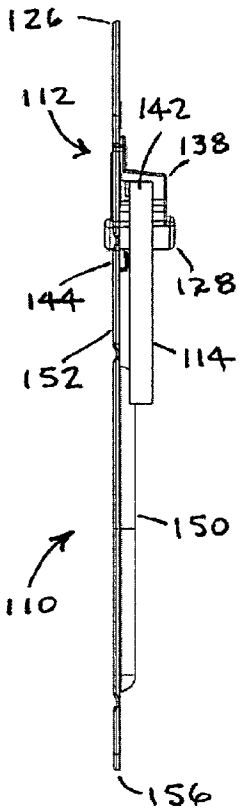
FIG. 26 is a right side view of the second embodiment of the temple hanger assembly shown in FIG. 23.
Figure 25:
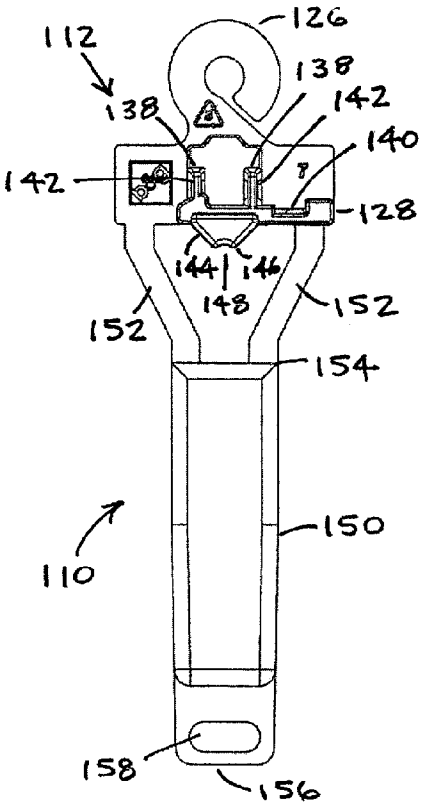
FIG. 25 is a rear view of the second embodiment of the temple hanger assembly shown in FIG. 23.
Figure 24:
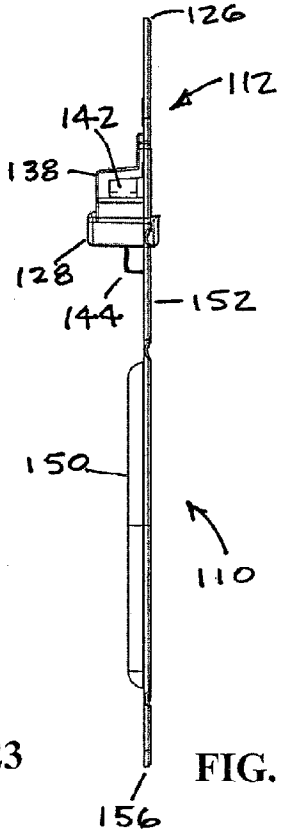
FIG. 24 is a left side view of the second embodiment of the temple hanger assembly shown in FIG. 23.
Figure 23:
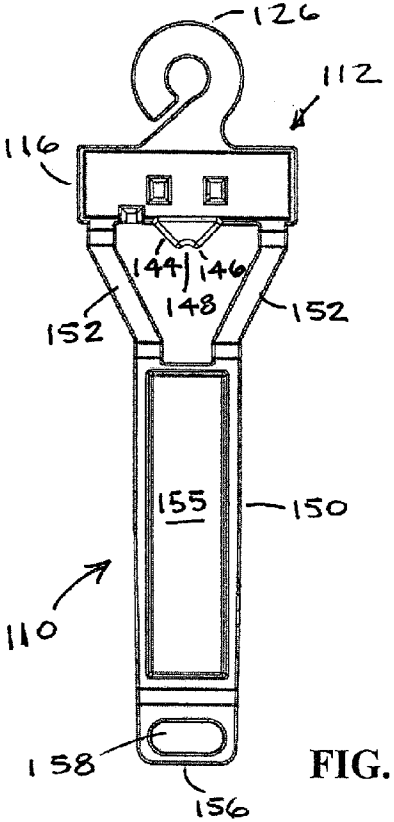
FIG. 23 is a front view of the second embodiment of the temple hanger assembly for eyeglasses of the present invention.
Figure 27:
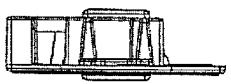
FIG. 27 is a bottom view of the second embodiment of the temple hanger assembly shown in FIG. 23.

FIGS. 23-27 show the temple hanger assembly 110 without the zip-tie 114. FIG. 23 shows the cavity 155 in the security device support section 150 that receives the security device 160. FIG. 23 also shows how the temple hanger 112 is connected to the security device support section 150 by the two flexible straps 152. FIG. 24 shows the left side view of the temple hanger assembly 110 and the aperture 142 in the center wall 138 that receives the zip-tie 114. FIG. 25 shows a rear view of the temple hanger assembly 110 and the ledge 128 on the back side 120 of the temple hanger 112, which receives the zip-tie 114 to attach the eyeglasses 190 to the temple hanger assembly 110. FIG. 26 shows a right side view of the temple hanger assembly 110. FIG. 27 is a bottom view of the temple hanger assembly 110, which shows the ledge 128 extending from the side wall 116 of the temple hanger 112 and the groove 148 of the support member 144.

Figure 29:
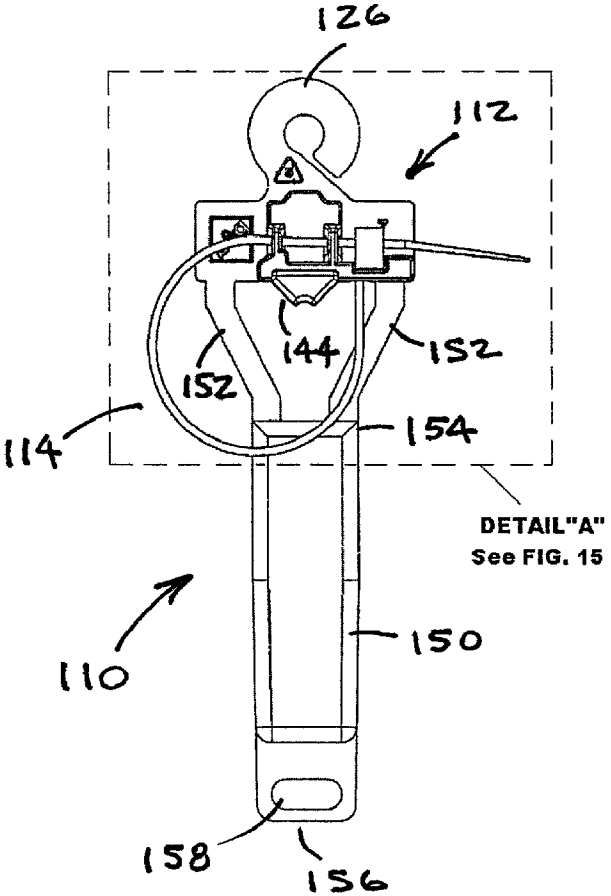
FIG. 29 is a rear view of the second embodiment of the temple hanger assembly shown in FIG. 23 with a zip-tie attached.
Figure 28:
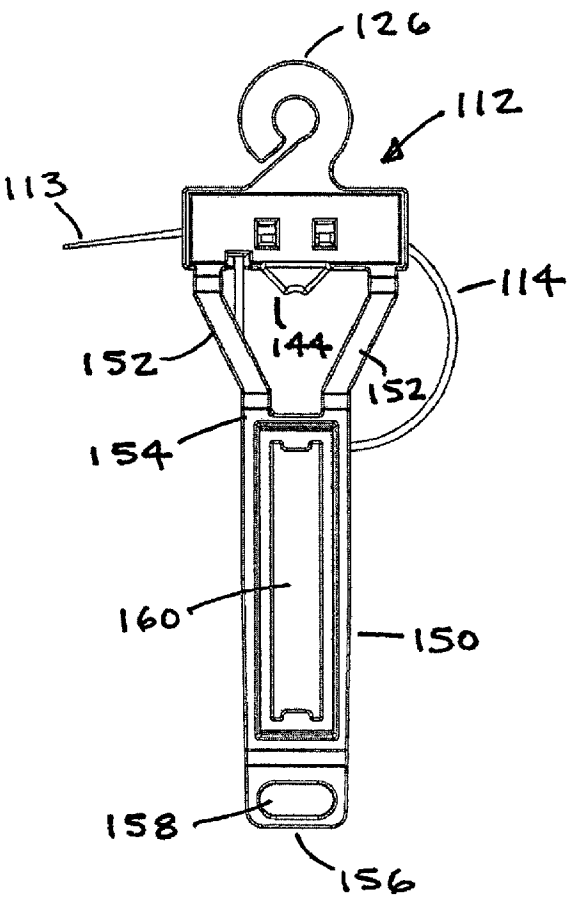
FIG. 28 is a front view of the second embodiment of the temple hanger assembly shown in FIG. 23 with a zip-tie attached.

FIGS. 28 and 29 show front and back views, respectively, of the temple hanger assembly 110 with a zip-tie 114. FIG. 28 shows how the security device 160 is installed in the security device support section 150. FIG. 29 shows how the zip-tie 114 is attached to the temple hanger 112. Detail "A" from FIG. 29 is shown in greater detail in FIG. 30 and provides a close-up view of the attachment structure on the ledge 128. The plain end 113 of the zip-tie 114 is inserted in the aperture 140 in the ledge 128 and pulled through until the locking mechanism 115 of the zip-tie 114 contacts the ledge 128. The plain end 113 is then looped around and inserted through the apertures 142 in the center walls 138 and fastened in the locking mechanism 115. FIG. 17 shows a pair of eyeglasses 190 attached to the temple hanger assembly 110 by passing the plain end 113 of the zip-tie 114 around the temple member 192 before it is inserted into the apertures 142 in the center walls 138. Tightening the zip-tie 114 secures the temple member 192 of the pair of eyeglasses 190 in the groove 148 of the support member 144.

FIGS. 31-33 show the zip-tie 114 with plain end 113 and locking mechanism 115. FIG. 31 shows the zip-tie 114 in a straight configuration. FIG. 32 shows the zip-tie 114 after the plain end 113 is inserted into the locking mechanism 115 and FIG. 33 shows the zip-tie 114 after the plain end 113 is pulled to tighten the zip-tie 114 around an object. As illustrated in FIG. 1, similar zip-ties 14 can also be used with the first embodiment of the temple hanger assembly 10.

Figure 30:
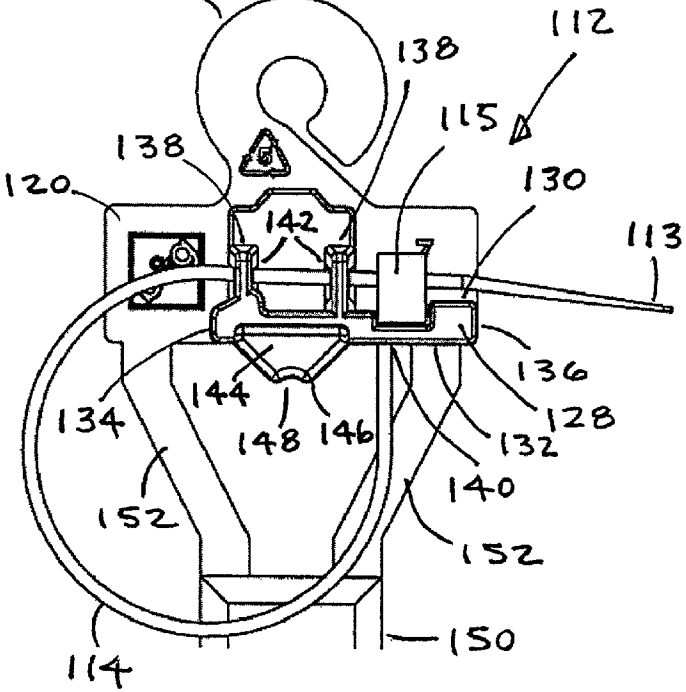
FIG. 30 is Detail "A" showing the top portion of the second embodiment of the temple hanger assembly from FIG. 29.

FIG. 30 also shows a support member 144 extending from the bottom surface 132 of the ledge 128 to beyond the bottom edge 124 of the side wall 116. The support member 144 has a distal end 146 with a groove 148 for receiving one of the temple members 192 of the pair of eyeglasses 190. The groove 148 is preferably perpendicular to the side wall 116 of the hanger 112 and is adapted to receive one of the temple members 192 of the eyeglasses 190 (FIGS. 16-17 and 21-22).

In FIG. 30, the support member 144 is substantially triangular in shape. However, the support member 144 can have other shapes. The important feature of the support member 144 is the groove 148 at its distal end 146, which properly orients the pair of eyeglasses 190 relative to the side wall 116 of the hanger 112. The support member 144 and groove 148 also allow the zip-tie 114 to loop very tightly around the ledge 128 and the temple member 192 of the pair of eyeglasses 190 (FIG. 17) to secure the eyeglasses 190 to the temple hanger assembly 110. The zip-tie 114 can be made from a plastic, such as polypropylene, or nylon but other well known materials can also be used. If the support member 144 did not have a groove 148, a gap between the ledge 128 and the zip-tie 114 would be formed. This gap could be large enough to allow the eyeglasses 190 to be removed from the hanger 112 and defeat one of the main objectives of the invention. Therefore, the groove 148 on the distal end 146 of the support member 144 insures that the hangar 112 is securely attached to the eyeglasses 190. Moreover, because the zip-tie 114 is tightly secured around the ledge 128 of the hanger 112, it is very difficult for a thief to remove the hanger 112 from the eyeglasses 190. This allows the security device 160, such as an EAS device, for pilfer protection to be attached to the hanger 112 with confidence that it will not be easily separated from the eyeglasses 190.

FIG. 31 shows the security device 160 that can be inserted into the security device support section 150 to provide a theft deterrent or a means for identifying the object attached to the tag 110 for inventory and tracking.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A temple hanger assembly for attachment to a pair of eyeglasses having a frame with first and second temple members connected to first and second hinged legs, respectively, the temple hanger assembly comprising:

a hanger having a side wall comprising a front side, a back side, a top edge and a bottom edge;

a ledge extending outwardly from the back side of the side wall, wherein the ledge comprises a top surface, a bottom surface, a first end and a second end;

a support member extending from the bottom surface of the ledge to a distal end with a groove; and a zip-tie having a plain first end and a second end with a locking mechanism, wherein the first temple member of the eyeglasses is positioned in the groove of the support member and the zip-tie surroundingly engages the ledge and the first temple member to secure the hanger to the eyeglasses.

2. The temple hanger assembly according to claim 1 further comprising a hook extending from the top edge of the side wall of the hanger.

3. The temple hanger assembly according to claim 2, wherein the hanger has a vertical axis extending between the top edge and the bottom edge, and wherein the hook and the support member are aligned with each other and substantially parallel to the vertical axis.

4. The temple hanger assembly according to claim 1, wherein one or more center walls extend from the top surface of the ledge and wherein a bar code is affixed to the hanger.

5. The temple hanger assembly according to claim 1, wherein the support member is substantially triangular in shape and has three sides and three corners, and wherein a first side is disposed next to the bottom surface of the ledge and a first corner opposite the first side forms the distal end.

6. The temple hanger assembly according to claim 1, wherein the ledge further comprises one or more center walls extending from the top surface between the first and second ends, a first aperture in the ledge located between the center walls and the second end and one or more second apertures in the one or more center walls.

7. The temple hanger assembly according to claim 6, wherein the first end of the zip-tie is inserted into the first aperture in the ledge from the top surface and around the first temple member and the first end of the ledge, through the one or more second apertures in the one or more center walls and into the locking mechanism, and wherein, when the zip-tie is tightened, the hanger is secured to the eyeglasses.

8. The temple hanger assembly according to claim 1, wherein the locking mechanism on the second end of the zip-tie is larger than the first aperture in the ledge.

9. The temple hanger assembly according to claim 1, wherein, when the zip-tie secures the hanger to the pair of eyeglasses, the locking mechanism on the second end of the zip-tie can not be unlocked.

10. The temple hanger assembly according to claim 1, wherein the support member extends beyond the bottom edge of the side wall.

11. The temple hanger assembly according to claim 1 further comprising a security device support section comprising a first end attached to the bottom edge of the hanger.

12. The temple hanger assembly according to claim 11, wherein the security device support section further comprises a second distal end with an aperture and a cavity located between the first end of the support section and the second distal end, and wherein a security device is installed in the cavity.

13. The temple hanger assembly according to claim 12, wherein the first leg of the eyeglasses is inserted in the aperture in the security device support section before the zip-tie secures the hanger to the eyeglasses.

14. The temple hanger assembly according to claim 12, wherein the security device is a radio frequency identification (RFID) tag or electronic article surveillance (EAS) tag.

15. A temple hanger assembly for attachment to a pair of eyeglasses having a frame with first and second temple members connected to first and second hinged legs, respectively, the temple hanger assembly comprising:

a hanger having a side wall comprising a front side, a back side, a top edge and a bottom edge;

a ledge extending outwardly from the back side of the side wall, wherein the ledge comprises a top surface, a bottom surface, a first end, a second end, one or more center walls extending from the top surface between the first and second ends, a first aperture in the ledge located between the center wall and the second end and one or more second apertures in the one or more center walls;

a support member extending from the bottom surface of the ledge to a distal end with a groove;

a security device support section comprising a first end attached to the bottom edge of the hanger;

a security device installed in the security device support section; and a zip-tie having a plain first end and a second end with a locking mechanism, wherein the first temple member of the eyeglasses is positioned in the groove of the support member and the zip-tie surroundingly engages the ledge and the first temple member to secure the hanger to the eyeglasses.

16. The temple hanger assembly according to claim 15 further comprising a hook extending from the top edge of the side wall of the hanger.

17. The temple hanger assembly according to claim 15, wherein the security device support section further comprises a second distal end with an aperture and a cavity located between the first end of the support section and the second distal end, wherein the security device is installed in the cavity, and wherein the first leg of the eyeglasses is inserted in the aperture in the security device support section before the zip-tie secures the hanger to the eyeglasses.

18. The temple hanger assembly according to claim 15, wherein the security device is a radio frequency identification (RFID) tag or electronic article surveillance (EAS) tag.

19. The temple hanger assembly according to claim 15, wherein the first end of the zip-tie is inserted into the first aperture in the ledge from the top surface and around the first temple member and the first end of the ledge, through the one or more second apertures in the one or more center walls and into the locking mechanism, and wherein, when the zip-tie is tightened, the hanger is secured to the eyeglasses.

20. The temple hanger assembly according to claim 15, wherein the support member is substantially triangular in shape and has three sides and three corners, and wherein a first side is disposed next to the bottom surface of the ledge and a first corner opposite the first side forms the distal end.

21. The temple hanger assembly according to claim 15, wherein the security device support section is attached to the hanger by one or more straps.

* * * * *